US006257422B1

(12) United States Patent
Rios

(10) Patent No.: US 6,257,422 B1
(45) Date of Patent: Jul. 10, 2001

(54) ARTICLE HOLDER

(76) Inventor: Jaime Rios, 754 Cardinal Dr, Livermore, CA (US) 94550

( * ) Notice: Subject to any disclaimer, the term of this patent is extended or adjusted under 35 U.S.C. 154(b) by 0 days.

(21) Appl. No.: 09/450,839

(22) Filed: Nov. 29, 1999

(51) Int. Cl.[7] ..... A47F 5/00

(52) U.S. Cl. ..... 211/45; 211/89.01; 40/124; 248/316.7

(58) Field of Search ..... 211/45, 89.01, 211/50; 248/316.1, 316.2, 316.3, 316.7; 40/104

(56) References Cited

U.S. PATENT DOCUMENTS

| | | | | |
|---|---|---|---|---|
| 1,602,341 | | 10/1926 | Day . | |
| 1,852,457 | | 4/1932 | Greiesbach . | |
| 1,893,594 | | 1/1933 | Oestreich . | |
| 2,530,821 | | 11/1950 | Hubbell . | |
| 2,779,114 | | 1/1957 | Orthwine . | |
| 2,785,919 | | 3/1957 | Grondzik . | |
| 3,168,954 | * | 2/1965 | Vanterrmann | 211/50 |
| 3,671,004 | | 6/1972 | Cram . | |
| 4,010,517 | | 3/1977 | Kapstad . | |
| 4,105,127 | | 8/1978 | Höll . | |
| 4,194,635 | | 3/1980 | Ferrara . | |
| 4,324,337 | * | 4/1982 | Hemalahti | 211/89.01 |
| 4,479,584 | | 10/1984 | Raz . | |
| 4,629,075 | | 12/1986 | Hutten . | |
| 4,735,393 | * | 4/1988 | Albee | 248/316.3 X |
| 4,773,545 | | 9/1988 | Jones . | |
| 4,899,974 | | 2/1990 | Wear et al. . | |
| 5,251,766 | | 10/1993 | Barry . | |
| 6,003,259 | * | 12/1999 | Kvapf et al. . | |

* cited by examiner

*Primary Examiner*—Robert W. Gibson, Jr.
(74) *Attorney, Agent, or Firm*—Theodore J. Bielen, Jr.

(57) ABSTRACT

An article holder utilizing a backing member a first portion is movable relative to the backing member. The first portion and the backing member form a cavity. A first hinge interconnects the first portion to the backing member. The first hinge biases the movement of the first portion toward the backing member in a spring-like fashion. The second portion is movable relative to the first portion and extends into the cavity. A second hinge interconnects the second portion to the first portion, biasing movement of the second portion toward the backing member. An article is held between the second portion and the backing member in this manner.

3 Claims, 1 Drawing Sheet

ARTICLE HOLDER

BACKGROUND OP THE INVENTION

The present invention relates to an article holder which is useful in multiple fields of use.

Sheets of material and loose papers must often be held in a certain position for the purpose of viewing, segregation from other like-sheets or papers, mounting above a work surface, and the like.

In the past, articles or papers have been held in a certain position by the use of tape, thumb tacks, glue, hook and pile fastener.

U.S. Pat. Nos. 1,852,457, 1,893,594, 2,779,114, 4,105,127, 4,479,584, and 4,899,974 show holders for cards and sheets which utilize spring members and channels to hold the cards in an upright position.

U.S. Pat. No. 2,785,919 shows a holding device for tobacco leaves in which a flexible insert is used within an inverted channel. The channel is supported between rails.

U.S. Pat. Nos. 2,530,821, 4,010,517, 4,194,635, 4,773,545, and 5,251,766 depict elongated retainers which are mountable on a wall and include a flexible flange or insert to hold the sheet material in place between the flexible flange and the holder.

U.S. Pat. No. 4,629,075 describes a mounting strip having an inverted channel and a clamp within the channel for hanging strips in a downward position.

U.S. Pat. Nos. 1,602,341 and 3,671,004 describe channels members having spring loaded clips that press a sheet of paper to a surface adjacent to the support.

A simple and reliable sheet holder which may be formed into a continuous member would be a notable advance in the mechanical arts.

BRIEF SUMMARY OF THE INVENTION

The present invention relates to a novel article holder.

The article holder of the present invention includes a backing member which may be an elongated flat piece of material. The backing member may be rested on a surface or mounted to the surface utilizing fixing means. For example, fixing means may take the form of glue, hook and pile fasteners, magnetic strips, and the like. The backing member may extend a predetermined length, preferably corresponding to the width of sheet of material, such as pages or papers, being supported by the holder of the present invention. Another element of the present invention is a first portion which is movable relative to the backing member the first portion and the backing member form an open cavity therebetween. The first portion may be contiguous with the second portion. Reinforcing means may also be included between the backing member on the first portion to provide strength to the article holder of the present invention.

A first hinge interconnects the first portion to the backing member. The first hinge also biases movement of the first portion toward the backing member. The reinforcing means may also serve to adjust the degree of biasing between the backing member of the first portion through the first hinge. The first hinge may be formed contiguously with the backing member and the first portion, exhibiting such biasing movement through resiliency and memory inherent to the material being used to form these elements. For example, the backing member first portion and first hinge may be formed of a plastic materials, elastomeric materials, and the like.

The article of the present invention also includes a second portion which is movable relative to the first portion. The second portion is oriented to extend into the cavity formed by the first portion and the backing member. The second portion may be formed as a unitary member with the first portion and the backing member.

A second hinge interconnects the second portion to the first portion. The second hinge, similar to the first hinge, biases movement of the second portion away from the first portion and toward the backing member. An article, such as a sheet of paper, is held between the second portion and the backing member in this manner. Again, the second hinge may be formed as a separate item or contiguously with the backing member, first portion, first hinge, and second portion by the use of flexible materials having a positional memory. In essence, the article is held between the second portion and the backing member at an edge portion along the second portion. Such edge portion may include a plurality of fingers to evenly distribute the force of the second portion against the article being held. The multiple fingers also facilitate the insertion and removal of the article being held from the cavity and into a position between the edge of the second end portion and the backing member.

It may be apparent that a novel and useful article for holding objects has been hereinabove described.

It is therefore an object of the present invention to provide an article holder in which a sheet of material, such as a sheet of paper, may be easily held and removed from such holder.

Another object of the present invention is to provide an article holder which is easily mounted to a surface and is capable of holding sheets of material on a vertical surface.

A further object of the present invention is to provide an article holder which may be constructed of a single unit of material and may be formed of a predetermined size to hold single or multiple sheets of material to a surface.

A further object of the present invention is to provide an article holder for sheets of material which supports sheets of material to a horizontal or vertical surface without damaging the same.

The invention possesses other objects and advantages especially as concerns particular characteristics and features thereof which will become apparent as the specification continues.

Reference is made to the following detailed drawings illustrating the present invention.

For a better understanding of the invention reference is made to the following detailed description of the preferred embodiments thereof which should be referenced to the prior described drawings.

DETAILED DESCRIPTION OF THE PREFERRED EMBODIMENTS OF THE INENTION

Various aspects of the present invention will evolve from the following detailed description of the preferred embodiments which should be taken in conjunction with the hereinabove described drawings.

Figure 1:
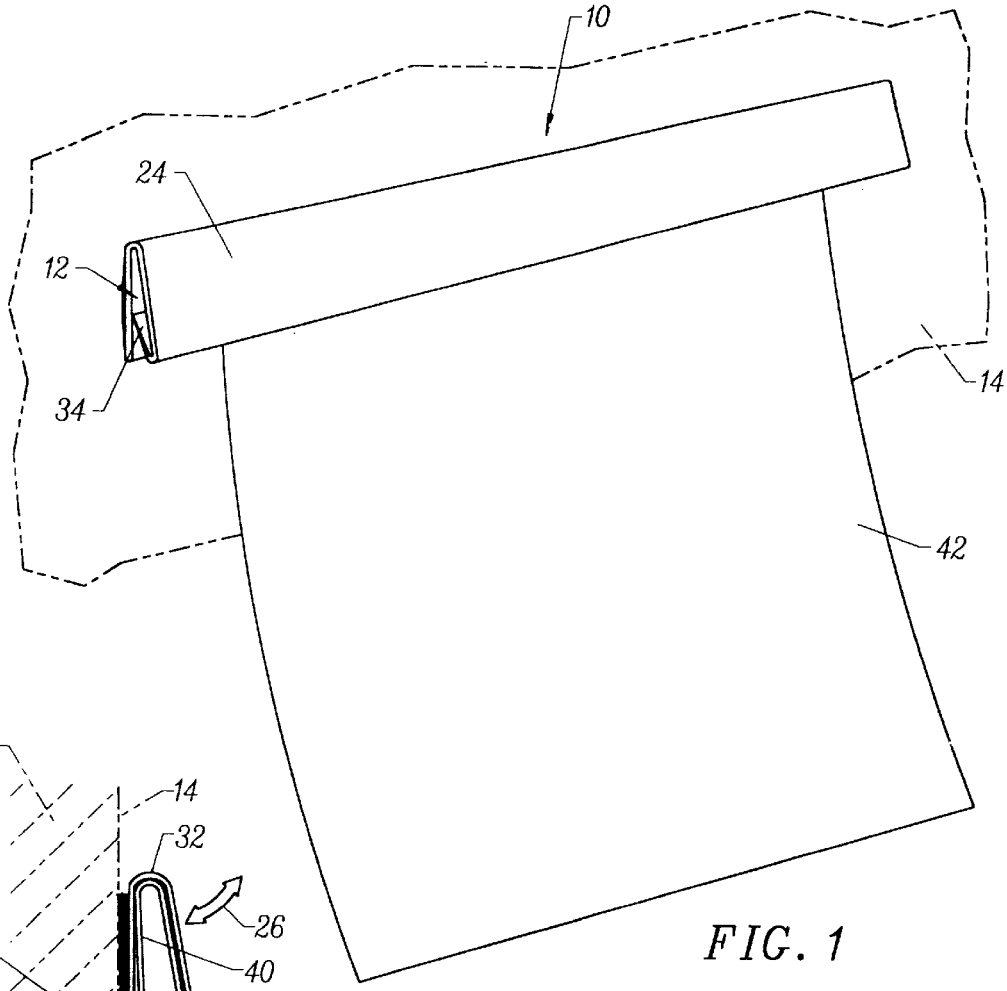
FIG. 1 is a top left perspective view of one embodiment the article holder of the present invention in place on a vertical surface.
Figure 2:
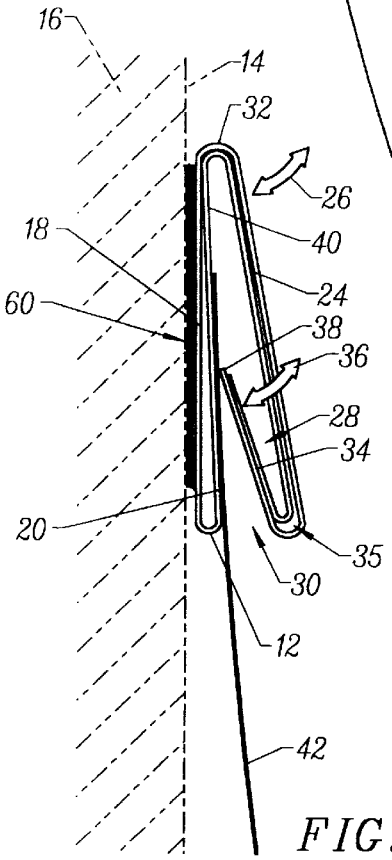
FIG. 2 is a end elevational view of article holder of FIG. 1 showing the mounting surface in section.

The invention as a whole is shown in the drawings by reference character 10. Article holder 10 includes as one of its elements a backing member 12 which extends along a mounting surface 14. As depicted in FIGS. 1 and 2, mounting surface 14 is vertically oriented and is part of a mounting member 16 which may be a wall, poster-board, door, and the like. Backing member 12 is depicted as having two layers of material 18 and 20, FIG. 2. However, backing member 20 may be formed in to a unitary piece such as backing member 22 depicted in FIG. 3 which respect to embodiment 10A, which will be discussed in greater detail hereinafter.

First portion 24 is also employed in the holder 10 of the present invention. First portion 24 is movable relative to backing member 22, directional arrow 26. First portion 24 and backing member 22 create a cavity 28. Cavity 28 is generally formed as an open cavity, having a mouth or entry portion 30 thereto.

First hinge 32 interconnects first portion 24 to backing member 12. First hinge 32 further biases movement of first portion 24 toward backing member 12. First hinge 32 is formed as a U-shaped interconnection between backing member 12 and first portion 24. In certain instances, hinge 32 may be fuse welded at its apex. That is to say, hinge 32 obtains its spring-like flexibility from such fuse welding and/or the material employed in its construction. Plastic, elastomeric, and other materials will serve in this regard.

Holder 10 also includes a second portion 34 which is movable relative to first portion 24. Second hinge 35, similarly constructed to hinge 32 biases such movement. Directional arrow 36 illustrates such movement. Second portion 34 extends into cavity 28 and includes an edge portion 38 which contacts inner surface 40 of backing member 12. Article 42, which may be a sheet of paper, is held relative to surface 14 between edge portion 38 of second portion 34 and backing member 12, specifically inner surface 40 of backing member 12. FIGS. 1 and 2 illustrate the holding of article 42, in this manner.

Figure 3:
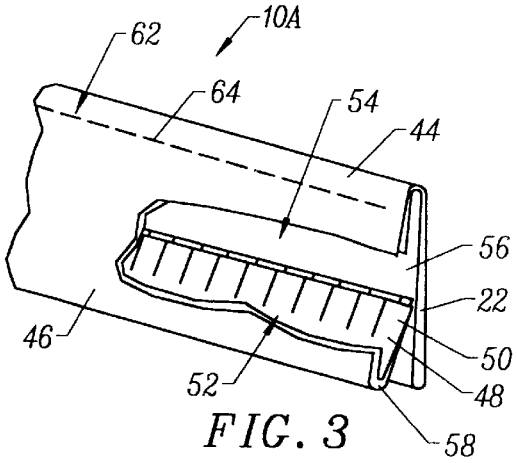
FIG. 3 is a top right perspective view of another embodiment of the article holder of the present invention, with a cut-away portion depicting the plurality of fingers found in the second end portion of the article holder.

Turning to FIG. 3, it may be observed that a holder 10A is illustrated in which a backing member 22 is shown. Hinge 44 and second portion 46 are similarly arranged to comparable elements depicted in embodiment 10, most clearly illustrated in FIG. 2. However, backing member 22, hinge 44, and first portion 46 are formed into one layer rather than the double layer depicted in embodiment shown in FIG. 2. Also, a second portion 48 of holder 10A includes an end portion 50 possessing a plurality of slits 52 therealong which forms a plurality of fingers 54, each of which press against inner surface 56 of backing member 22. In this manner, pressure from second portion 48 via hinge 58 is evenly distributed along inner surface 56 of backing member 22 to hold an article, such as article 42.

Fixing means 60 is also employed to hold article 10, or article 10A, to surface 14. Fixing means 40 is depicted in FIG. 2 as a hook and pile type fastening means. However, fixing means 60 may take the form of glue, magnetic strips, independent fasteners, such as nails, tacks, screws, and the like. Fixing means 60 is particularly useful when mounting surface 14 is a vertical surface.

Reinforcing means 62 is also depicted in FIG. 3. Reinforcing means 62 is shown as a sewn-through seam. Such reinforcing means 62 adds strength to holder 10A and also adjusts the resiliency or biasing action of hinge 44. In other words, reinforcing means 62 may reduce the resiliency of hinge 44 when sewn-through seam 64 is used to tighten the inner connection between first portion 46 and backing member 22.

In operation, the user mounts holder 10 or 10A to a surface 14 using fixing means 60. An article, such as article 42, is then slipped into cavity 28 and held in that position by the force exerted by second portion 34 against inner surface 40 of backing member 12. Such biasing force is due to hinge 35 found between second portion 34 and first portion 24, as well as first hinge 32 found between first portion 24 and backing member 12. With respect to embodiment 10A, FIG. 3, resilient fingers 54 distribute the pressure of such biasing action along article 42 held in cavity 28 formed by first portion 46 and backing member 22. In most cases, article 42 may be gently pulled downwardly from cavity 28 of article 10 or removed by simply pushing first member 34 and connected second member 24 manually away from backing member 12.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An article holder, comprising:

a. a backing member;

b. a first portion movable relative to said backing member, said first portion and said backing member forming an open cavity therebetween;

c. a first hinge interconnecting said first portion to said backing member, said first hinge further biasing movement of said first portion toward said backing member, said first hinge further comprising a contiguous flexible hinge between said backing member and said first portion, said first joint being constructed of a material having a memory;

d. a second portion movable relative to said first portion, said second portion extending into said cavity;

e. a second hinge interconnecting said second portion to said first portion, said second hinge further biasing movement of said second portion away from said first portion and toward said backing member, to hold an article therebetween, said second hinge comprising a contiguous flexible joint between said said first portion and said second portion, said second hinge being constructed of a material having a memory;

f. fixing means for mounting said backing member to a surface; and g. reinforcing means between said backing member and said first portion.

2. An article holder, comprising:

a. a backing member;

b. a first portion movable relative to said backing member, said first portion and said backing member forming an open cavity therebetween;

c. a first hinge interconnecting said first portion to said backing member, said first hinge further biasing movement of said first portion toward said backing member, said first hinge further comprising a contiguous flexible joint between said backing member and said first portion, said first hinge being constructed of a material having a memory;

d. a second portion movable relative to said first portion, said second portion extending into said cavity said second portion further including an edge, said edge further comprising a plurality of fingers intended for contacting the article;

e. a second hinge interconnecting said second portion to said first portion, said second hinge further biasing movement of said second portion away from said first portion and toward said backing member, to hold an article therebetween, said second hinge comprising a contiguous flexible joint between said first portion and said second portion, said second hinge being constructed of a material having a memory;

f. fixing means for mounting said backing member to a surface; and g. reinforcing means between said backing member and said first portion.

3. The article of claim 1 in which said backing member, first portion, first hinge, second portion and second hinge comprise a contiguous member.

* * * * *